United States Patent [19]

Madsen

[11] Patent Number: 5,000,393

[45] Date of Patent: Mar. 19, 1991

[54] DISPENSER FOR ROLLS OF SHEET MATERIAL

[75] Inventor: Jay D. Madsen, Nashville, Tenn.

[73] Assignee: Rollar Corporation, Nashville, Tenn.

[21] Appl. No.: 410,876

[22] Filed: Sep. 22, 1989

[51] Int. Cl.[5] ..... B65H 19/00

[52] U.S. Cl. ..... 242/55.3; 221/297; 221/301; 242/55.53

[58] Field of Search ..... 242/55.3, 55.53; 221/294, 297, 298, 301

[56] References Cited

U.S. PATENT DOCUMENTS

| | | | |
|---|---|---|---|
| 2,870,663 | 1/1959 | Hübl | 221/301 X |
| 2,896,871 | 7/1959 | Woodruff | 242/55.3 |
| 3,039,709 | 6/1962 | Bolger | 242/55.3 |
| 3,865,295 | 2/1975 | Okamura | 242/55.3 |
| 4,034,924 | 7/1977 | Carlisle | 242/55.3 |
| 4,314,679 | 2/1982 | Paul et al. | 242/55.3 |

*Primary Examiner*—John M. Jillions
*Assistant Examiner*—Paul Thomas Bowen
*Attorney, Agent, or Firm*—Harrington A. Lackey

[57] ABSTRACT

A dispenser for rolls of sheet material including an upright roll chamber adapted to support at least three stacked rolls of sheet material, such as toilet paper, including a lower dispensing station, a primary reserve station above the dispensing station, and a secondary reserve station above the primary reserve station. Mounted for operative movement on opposite sides of the roll chamber at each station is a pair of eccentric rotary actuators, each adapted to rotate about a rotary axis extending front-to-rear, each actuator having a radial projection for entry into and withdrawal from the roll chamber on opposite sides of the rolls at the corresponding station in order to dispense sheet material from the roll at the dispensing station and to feed rolls downward from the upper reserve stations to the dispensing station when the lowermost roll is empty and its empty core has been discharged. The dispenser also includes a combination roll sensing and locking device to prevent the operation of the actuators when a full roll is in the lower dispensing station.

10 Claims, 6 Drawing Sheets

DISPENSER FOR ROLLS OF SHEET MATERIAL

BACKGROUND OF THE INVENTION

1. Field of the Invention

The invention relates to the dispensing of sheet material wound onto a hollow core, such as toilet paper, paper towels and the like. Specifically, the dispenser and dispensing method of the invention involves the handling of multiple rolls of material wound on hollow cores, without the necessity of spindles to be inserted, affixed, or retrieved.

2. Description of Prior Art

The prior art discloses devices that dispense and regulate rolls of sheet material wound on hollow cores, without the aid of a common spindle member supporting the rolled material. Specifically, these dispensers operate mechanical parts from both sides of the cabinet; in a synchronized manner, to regulate and dispense; by the intrusion into, or the withdrawal from the internal shaft.

Jaspersen U.S. Pat. No. 4,522,346 exemplifies a prior art dispenser for rolls of toilet paper having a transversely split core with a spring-loaded, pivoted lever that provides a biasing force to buckle the core sections, causing the core sections and spindle portions to disengage from the saddle members. This invention supposedly overcomes the problems of prior art, that being friction, disengagement of spindle and saddle members, and waste; but requires the manufacture of rolled product on transversely split cores to allow the invention to perform without difficulty.

Woodruff U.S. Pat. No. 2,896,871 may be noted as disclosing a dispenser for two rolls wound on a hollow core that dispenses and regulates the rolled product; by the intrusion into and the withdrawal from the internal shaft, by mechanical parts located at two specific locations. Specifically, these parts are located to (1) penetrate the ends of the hollow core of the dispensing roll, providing and replacing the function of the spindle, and (2) control the progress of the reserve roll by engaging the outside lower surface of the reserve roll, so that it does not contact the dispensing roll. During the transfer operation the exhausted roll (core) falls from the spindling rollers, and between the stops into a lower containment area, for removal at a later time; while these same stops provide a location point for the fresh roll, in order that the "rollers" may enter the internal shaft and spindle the rolled product.

The Woodruff dispensing cabinet allows very little access to the rolled product while at the dispensing location which lessens tampering and pilferage; but however, creates the problem of accessing the rolled product in order to feed the sheet material thru the limited access slot, as well as the time involved to accomplish this operation. In addition, this same involved operation would have to be repeated in the event that during operation, the sheet material fell back into the cabinet.

The mechanical workings of the Woodruff dispenser require more force to operate, than the force which the parts exert at the dispensing and regulating locations, due to the lack of leverage at the handle; and increased by the force of the return spring, which is needed to assure a positive return of said handle. In the Woodruff dispenser the stops for the rolled product are pivotal, and angled; and provide an inconsistent location point for said rolled product; allowing for the differences in width, weight, diameter, and texture of rolled product from different manufacturers. In the return action of the dispenser mechanics, the roll stops withdraw and the locating angle becomes more vertical; allowing the rolled product to drop, while the rollers intrude into the internal shaft to spindle the rolled product, thus increasing the possibility for misalignment between hollow core ends and the rollers (which are blunt and have no positive lifting capacity). The Woodruff dispenser is limited by mechanics and application to a total capacity of two rolls of product; and has no means whereby to restrict the transfer mechanics to their intended function; thus allowing for misuse and the possibility of jamming.

Bolger U.S. Pat. No. 3,039,709 may be noted as disclosing a dispenser for a plurality of rolls wound on hollow cores, that utilizes mechanical parts to dispense and regulate rolled product at three specific locations which, (1) penetrate the ends of the hollow core of the dispensing roll, providing and replacing the function of the spindle, (2) control the progress of the primary reserve roll by engaging the outside lower surface of the primary reserve roll, so that it does not contact the dispensing roll, and (3) regulate the progress of the secondary reserve rolls stationed above the primary reserve roll position by means of a biasing force against the sheet material. During the transfer operation the exhausted roll (core) falls to the bottom of the dispenser cabinet, while the new roll drops from the primary reserve position to the bottom of the cabinet, in order that the "studs" may enter the internal shaft and spindle the rolled product.

The Bolger dispenser's mechanical means for controlling the secondary reserve rolls utilizes a biasing force against the sheet material, causing distortion and possible damage to the sheet material; and therefore diminishing the quality and usefulness of said sheet material. Furthermore, during the transfer operation the spindling studs withdraw and allow the core to drop to the bottom of the cabinet; as well, the primary reserve roll drops and must also locate at the bottom of the cabinet; to align with the studs, in order to be spindled. Therefore, the core would prevent the new roll of product from locating in such a position as to be spindled; or causing the ejection of the new roll from the dispenser. In addition, as the primary reserve roll is released and drops to the bottom of the dispenser cabinet, there is no provision to restrain said roll from bouncing out thru the access opening, or being removed (pilferage); if said roll remains at the bottom and is spindled, the roll would drag against the bottom of the cabinet, as the spindling members are blunt and have no lifting capacity. The Bolger dispenser is limited by mechanics and application, and has no means whereby to restrict the transfer mechanism to the intended function; thus allowing for misuse, malfunction, and pilferage.

Carlisle U.S. Pat. No. 4,034,924 exemplifies a prior art dispenser for a plurality of rolls wound on hollow cores utilizing mechanical parts to dispense and regulate rolled product in three specific locations which, (1) penetrate the ends of the hollow core of the dispensing roll, providing and replacing the function of a spindle, (2) control the progress of the primary reserve roll by engaging the outside lower surface of the primary reserve roll, so that it does not contact the dispensing roll, and (3) regulate the progress of multiple secondary reserve rolls stationed above the primary reserve roll position by penetrating the hollow ends of the core of the lower-most secondary reserve roll. The Carlisle dispenser utilizes the three obvious locations for dispensing and regulating rolled product; however, the mechanical application used is complicated and requires a substantial amount of leverage to overcome the frictional resistance between the activation face and the maintaining fingers, as well as the guiding mechanism and the activation face. The contact surface between the activation face and the maintaining fingers is small, and consequently prone to wear; unless costly materials and/or fittings are employed to compensate for the frictional resistance. During the transfer operation the reserve roll drops to the bottom of the cabinet, thereby suitably located for the first roll maintaining finger pads to engage the hollow ends of the core of rolled product; said pads are shaped in such a fashion as to provide a nominal amount of lifting motion as they engage the hollow ends of the core. The amount of lifting motion at the spindling point directly determines the variety of roll sizes which may be utilized; and therefore becomes a limiting characteristic.

The prior art dispensers and dispensing methods are limited by their storage capacity; by their dispensing method, or by frictional resistance between the moving parts within the dispenser. Most, if not all, of the prior art dispensers are complex in design, making them expensive to manufacture and maintain and, thus more prone to failure.

SUMMARY OF THE INVENTION

The instant invention overcomes the aforementioned problems of the prior art dispensers. With this invention, the dispensing and regulating of rolled material and the discharge of an empty core from the dispensing station is achieved by the synchronized bilateral movement of three sets of axially mounted, eccentrically shaped actuators, which are joined by connecting arms, and coordinated by a common member (handle). The central internal shaft guides the rolled product with the aid of gravity to the dispensing station, interrupted only by the intrusion or withdrawal of the eccentrically shaped, axially mounted actuators. Therefore the user can; by a simple and easy movement of the handle, exchange an empty core for a fresh roll, while maintaining reserve rolls in the dispenser away from the replacement roll. In addition the dispenser utilizes a paper sensor which restricts the transfer mechanism until the dispensing roll is substantially consumed.

Therefore, by virtue of this concept, the principle objective of the invention is achieved; to overcome the problems inherent and existing in prior art dispensers.

Another object of the instant invention is to provide convenience, thrift, and sanitation by an integrated storage compartment and dispensing station, whereby the rolled product remains within the dispenser at all times. The instant invention makes the dispensing of a series of rolled product more convenient and efficient than any other dispenser. The instant invention requires no spindles to be affixed or retrieved and, therefore, does not suffer diminished capacity in the event they are misplaced or become lost.

A further object of the instant invention is to provide a design that is easily used by the consumer.

Another object of the instant invention is to provide a dispenser which has a large reserve roll capacity; benefiting both the consumer and the supplier.

A further object of the instant invention is to provide a dispenser that has a loading mechanism for rolled products, which allows greater ease and convenience for the supplier.

Another object of the instant invention is to provide a dispenser which has a positive roll holding mechanism with increased lifting power, while allowing free rotation of the dispensing roll.

A further object of the instant invention is to provide a dispenser that discourages pilferage of the rolled product by the use of an obscuring mechanism which restricts the dispensing position during the transfer operation. There is also a shielding mechanism that restricts access to the reserve rolls of product, which is fitted with a locking device. The dispenser is designed to be constructed of metal for commercial application, considering heavy use and the possibility of abuse. As well, the subject dispenser can be constructed of plastics, as a more economical alternative for residential application, where abuse and pilferage are not a great consideration Another object of the instant invention is to provide a dispenser that is simple in design and construction and, thus, reliable and efficient as well as economical to manufacture. Another object of the instant invention is to provide a dispenser that does not require a containment area for cores, which must be attended to periodically, to remove said cores of rolled product; but instead provides for automatic core ejection. The aforementioned and other objects of the invention will become apparent from consideration of the following detailed description of a preferred embodiment thereof, given in conjunction with the following drawings.

A DESCRIPTION OF A PREFERRED EMBODIMENT

Figure 1:
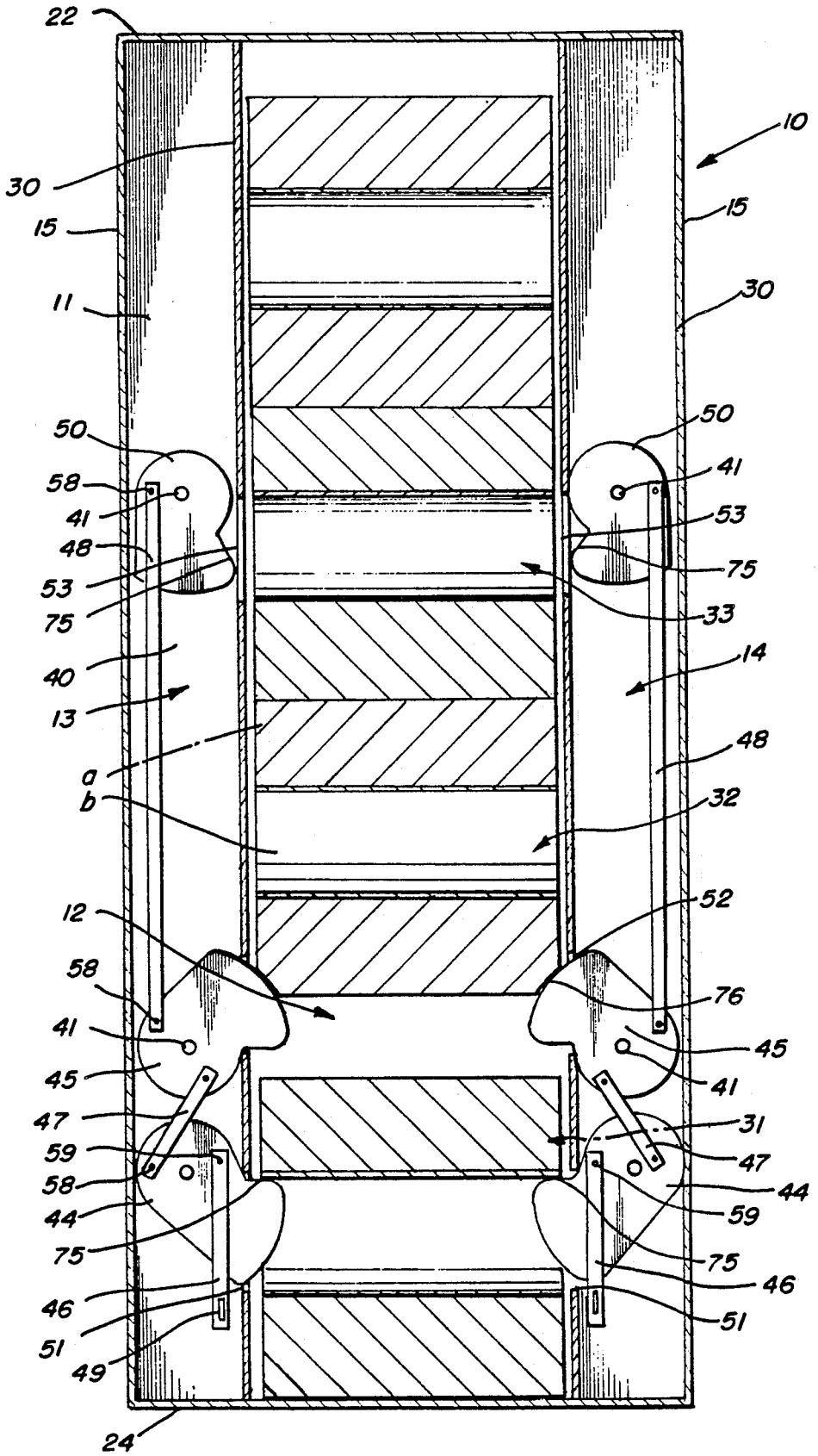
FIG. 1 is a sectional elevation taken along the line 1—1 of FIG. 9 of the dispenser, made in accordance with this invention, showing the actuators in their dispensing position.

A preferred embodiment of the instant invention, as shown in FIGS. 1–9 of the accompanying drawings, may be utilized for dispensing flexible sheet material (a) off a hollow core (b). The instant invention will be provided with appropriate openings (not shown) to accommodate the fasteners employed in affixing the dispenser (10) to the surface of a wall. Moreover, the dispenser (10) can be fitted with a mounting frame (not shown) to recess approximately two-thirds of the total depth into a wall cavity.

The Dispenser Housing

The dispenser or dispenser housing (10) is comprised of a back wall (11), two outer side walls (15), two internal shaft or side walls (30), and a front wall member or cover including an upper shield or door (17) and a lower shield or wall (20), and a top wall (22), and a bottom wall (24). An upright shaft or roll chamber (12) is confined between the internal side walls (30), while each pair of outer side wall (15) and the internal side wall (30) defines a compartment (13) and (14), respectively.

Figure 2:
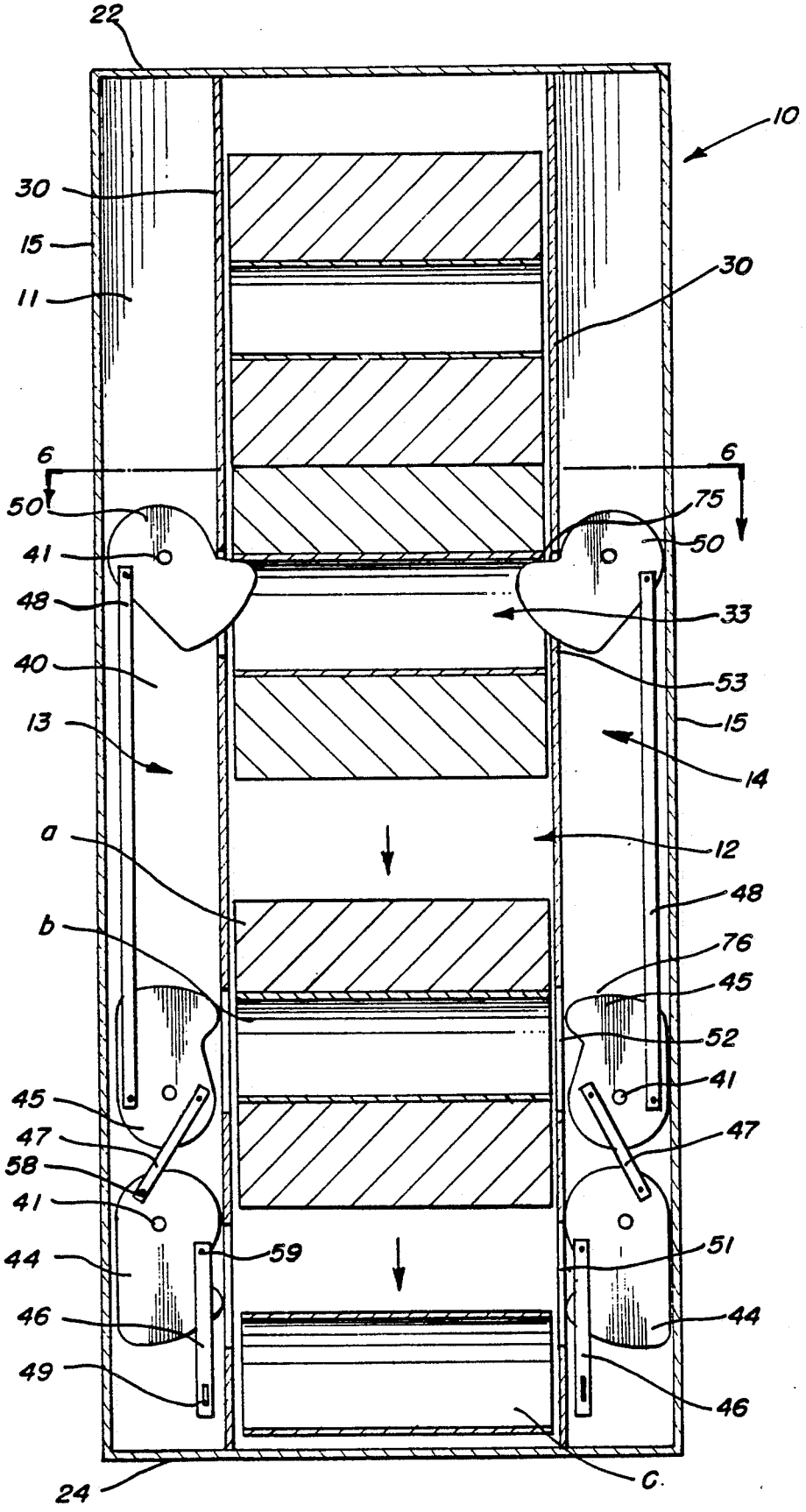
FIG. 2 is a sectional elevation similar to FIG. 1, showing the actuators in their transfer position.

The internal shaft walls (30) are relieved of material in such a fashion as to create three slots (51), (52), and (53) which are aligned vertically on center-line to the rolled product (a), FIGS. 1 and 2. The slots (51–53) are positioned relative to the rolled product and the designated function of that position, i.e., dispensing (51), primary reserve roll (52), and secondary reserve rolls (53). Holes (FIG. 8) are located in the lower rear portions of the internal shaft walls (30) to accommodate an axle (26) to pivotally support the changing mechanism (25), FIG. 4. A sensing hole (55) (FIG. 4) is positioned just to the front of the dispensing slot (51) to align with the end portion of the web or paper area of the rolled product (a), to allow the sensing device (36) entry into the internal shaft or roll chamber (12), so as to detect the presence or absence of rolled product (a), FIG. 5. Each internal side wall (30) is the mirror-image of the other.

Figure 6:
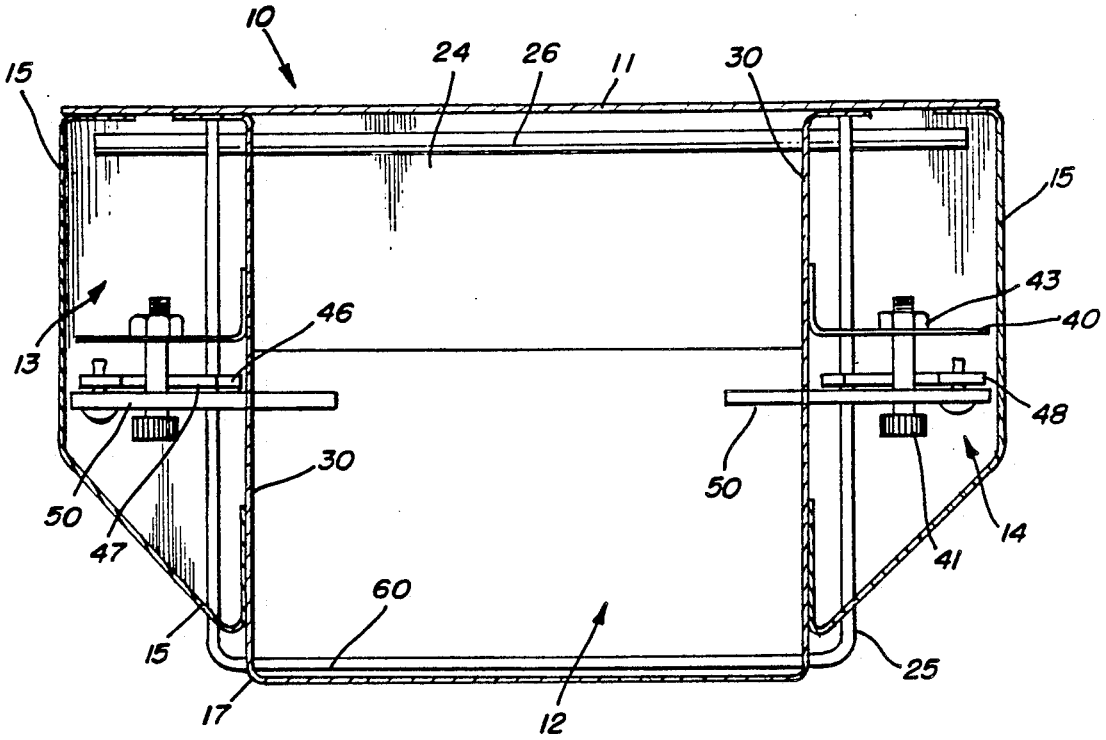
FIG. 6 is an enlarged plan section of the dispenser, taken along the line 6—6 of FIG. 2.
Figure 4:
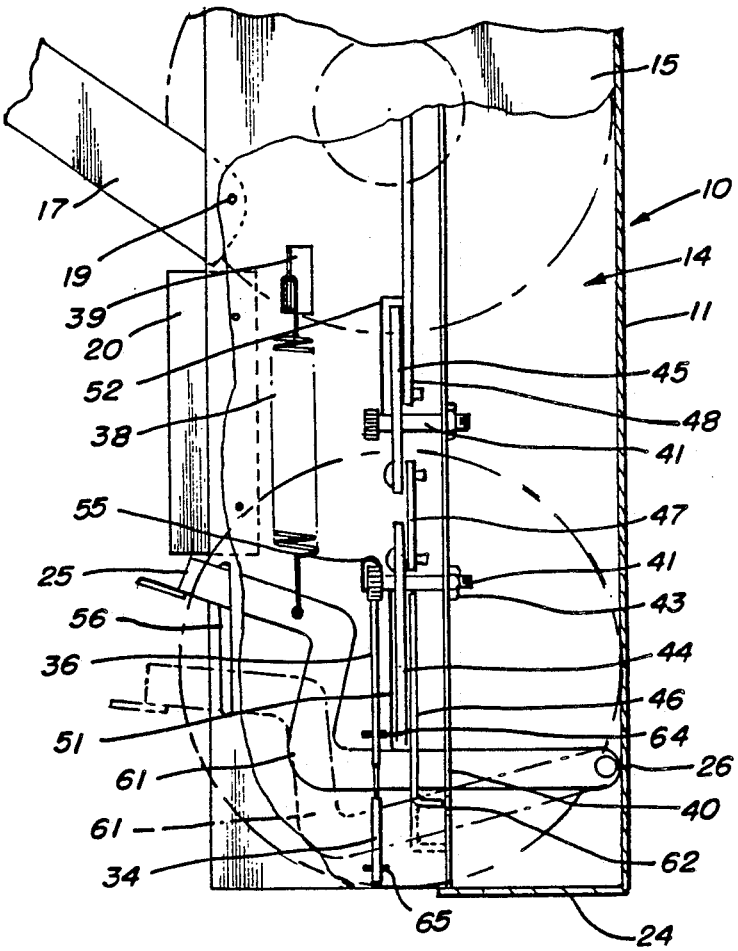
FIG. 4 is an enlarged, fragmentary right side elevational view of the lower portion of the dispenser, with a portion of the outer side wall broken away to show the relative positions of the internal mechanical components, including a roll sensing device.

The outer side walls (15) are roughly rectangular, with the outer front corners beveled at 45 degrees, FIG. 6, and a slot (56) formed in each of the lower front beveled faces, to allow movement of the changing apparatus (25), FIG. 4.

The internal shaft walls (30) are spaced apart the width of the rolled product plus a clearance of approximately 3/16"; to create the two sides of the roll chamber (12), in order to receive a plurality of vertically stacked rolled products or rolls of sheet material (a), whose axial hollow cores extend horizontally and transverse to the roll chamber (12). The outer side walls (15) are joined to the back wall (11) with rivets or the like (not shown), and are spaced laterally outward from the internal walls (30) to define the two smaller compartments on both sides of the main internal shaft or roll chamber (12), FIG. 6. The back wall (11) provides the third wall of the internal shaft (12), as well as providing a joining point for the side walls (15) and the inner shaft walls (30), as well as to stabilize the structure of the dispenser (10).

Figure 7:
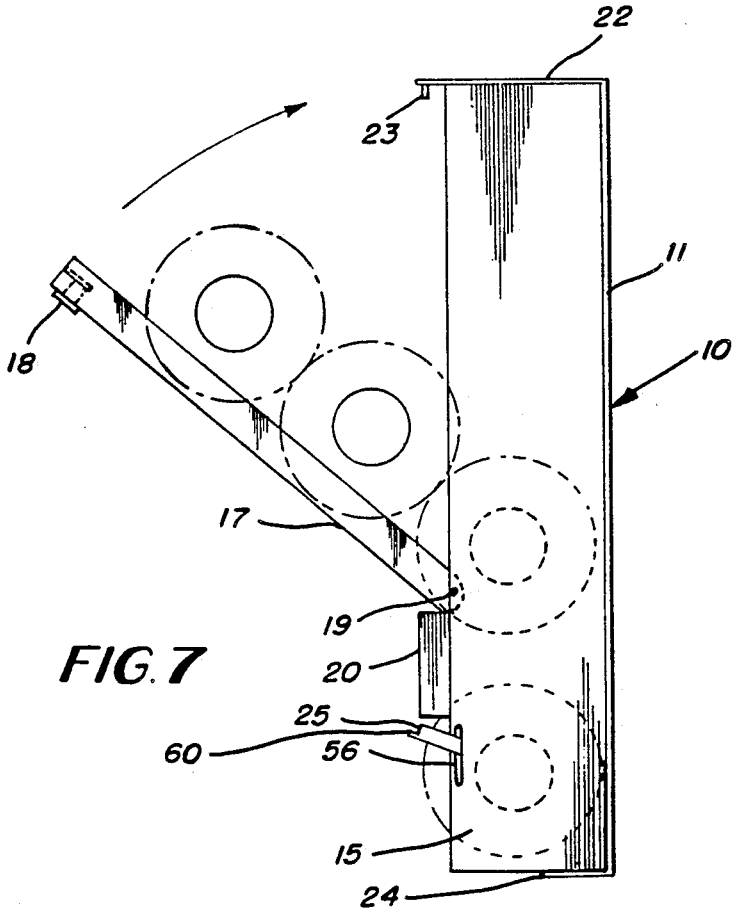
FIG. 7 is a right side elevational view showing the dispenser with the front door open, supporting to be loaded, rolled products.

The front wall member of the dispenser (10); and the fourth wall of the internal shaft (12), consists of a lower shield (20) which is fixed in a stationary position, and an upper shield (17) which is pivotally mounted by pivot pins (19), rivets or the like at its lower corners to the dispenser (10), to open and close a front access opening (21) in the dispenser (10) for easy access to, and loading of rolled product (a), FIGS. 4 and 7. The front access opening (21) is of substantially the same size and shape as the upper shield (17). The upper shield (17) is equpped with a locking device (18) cooperative with a locking retainer (23) on top wall (22) to secure the shield (17) in a closed position, FIG. 7.

The top wall (22) of the dispenser (10) fully covers the internal shaft or roll chamber (12) and side compartments (13 and 14).

Figure 8:
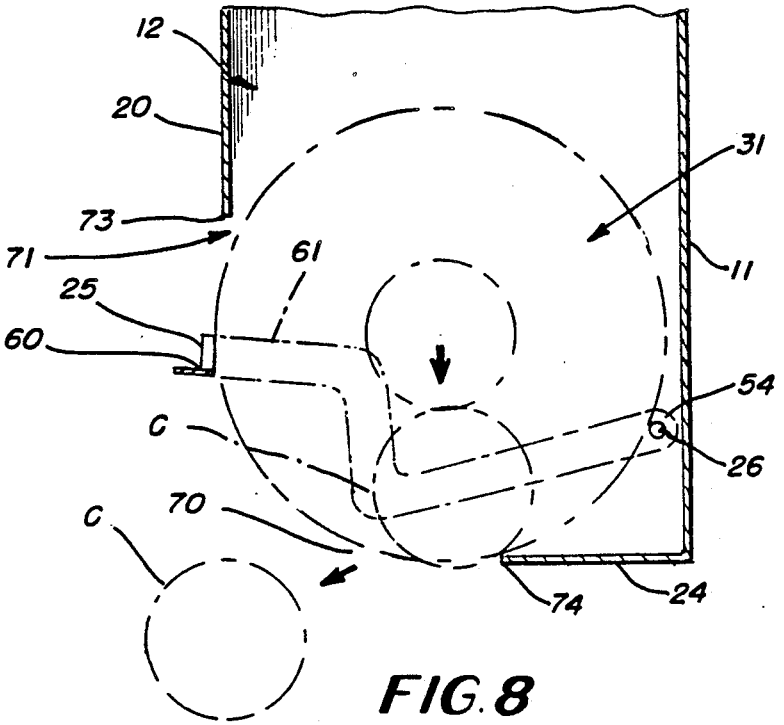
FIG. 8 is a greatly enlarged fragmentary section along the line 8—8 of FIG. 3 showing the ejection of an empty core when it contacts the partial bottom of the dispenser, and a full roll of sheet material and the changing mechanism in phantom lines, showing the locating and obscuring function of the changing mechanism in conjunction with the partial bottom.
Figure 9:
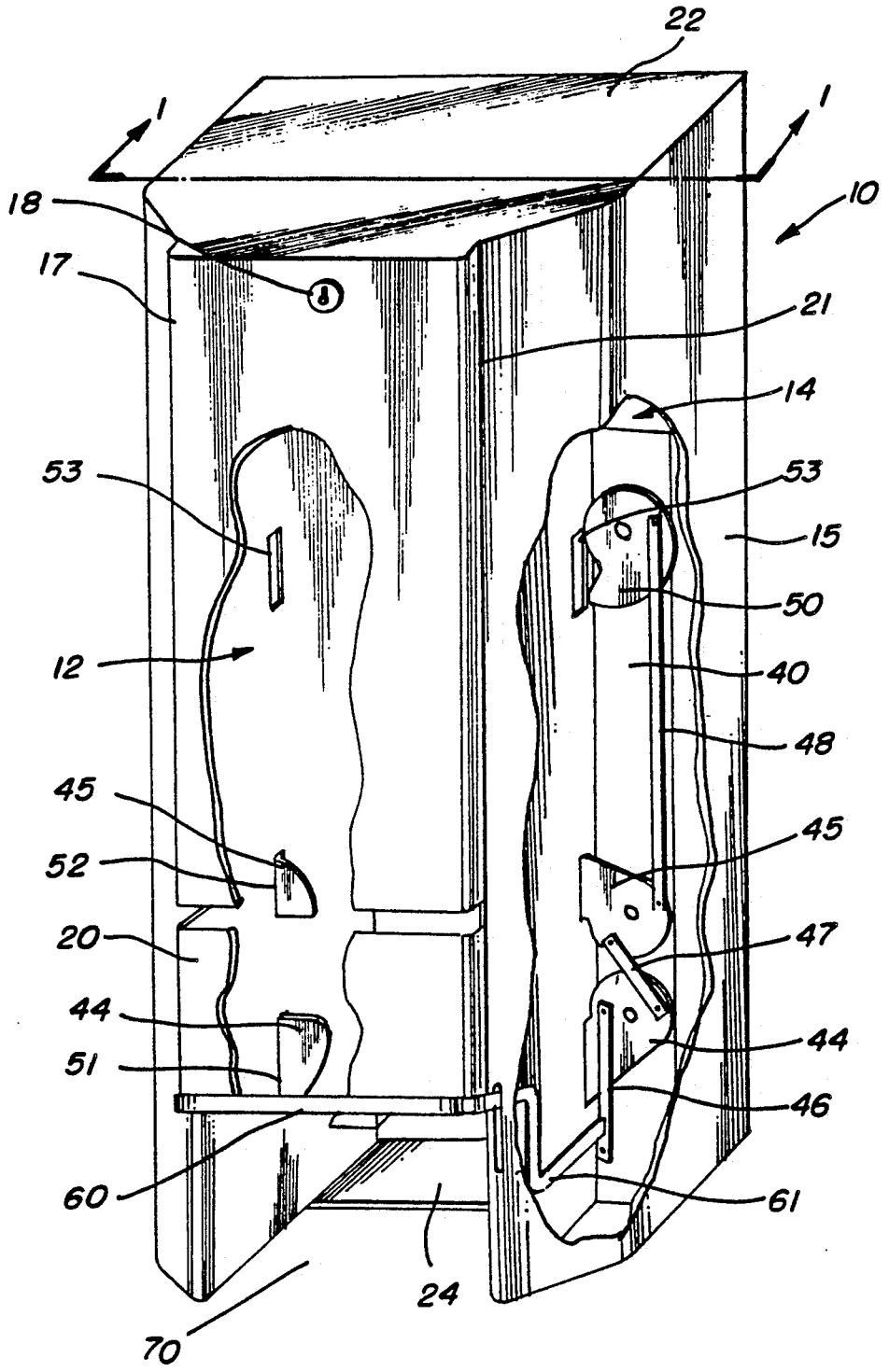
FIG. 9 is a front perspective view of the dispenser in accordance with the invention, with portions of the housing and shields cut away, showing one actuation assembly and the internal shaft and the dispensing position of the actuators.

The bottom wall (24) of the dispenser (10) covers both side compartments (13 and 14) and extends from the back wall (11) to a point slightly less than $\frac{1}{4}$ the total depth of the roll chamber (12), and as such functions as a location point for a new roll of product in the dispensing position, and as a location point for the ejection of an exhausted roll (i.e., core [b]), FIGS. 6 and 8.

Description of the Dispenser Mechanics

The two lateral compartments (13 and 14) provide the space required for the movement of the dispensing and regulating mechanical elements of the instant invention.

A mounting plate (40) is attached to the inner shaft walls (30), slightly to the rear of the center-line of the rolled product (a), and has three holes, not shown, located relative relative to the rolled product (a) at three different stations, namely the lower dispensing station (31), the primary reserve station (32), and the secondary reserve station (33). A shoulder bolt (41) is secured through each hole with a locking nut (43), to provide an axle or pivot pin for the pivotal movement of each of a plurality of eccentrically shaped actuators (44, 45, and 50), FIGS. 4 and 6.

The mounting plate (40) has a slot (62); in addition to the three holes, to allow the operator or changing mechanism (25) entry to the rear of the cabinet, to mount on the axle (26) providing pivotal movement, for the changing mechanism (25), FIGS. 6 and 4.

Figure 3:
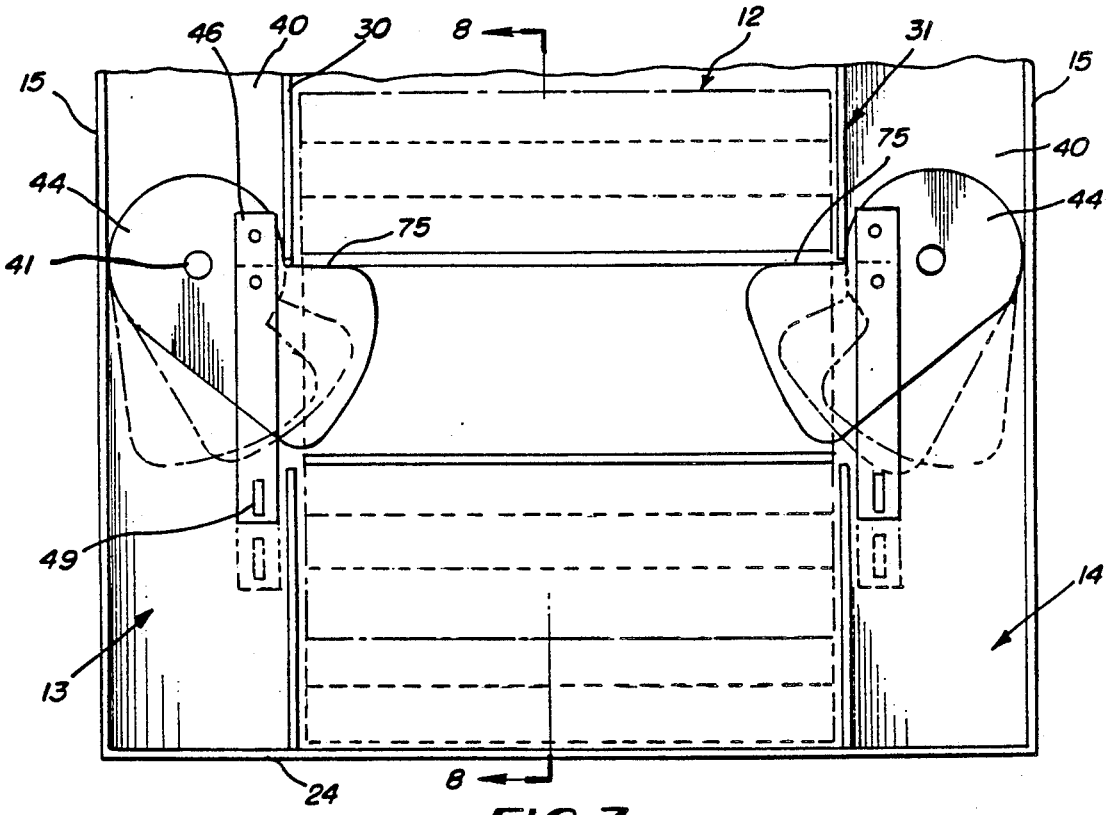
FIG. 3 is an enlarged front elevation of the lower portion of the dispenser showing the rolled product at the dispensing station and the lifting action of the spindling actuators. The actuators and rolled product in the dispensing position are shown in solid lines; while the lifting action of the actuators and the rolled product being lifted, are shown in phantom lines.
Figure 5:
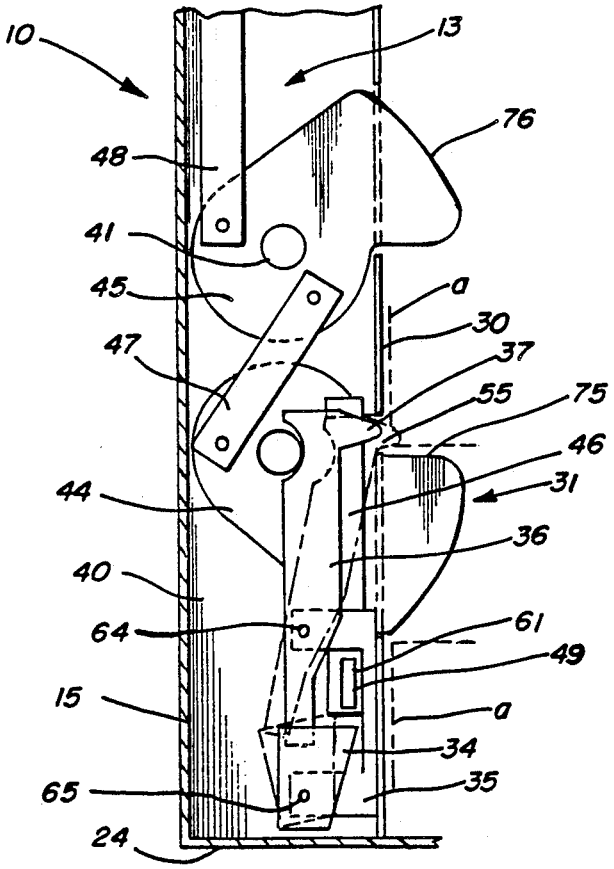
FIG. 5 is an enlarged, fragmentary front elevation of the left lower portion of the dispenser, illustrating the roll sensor and locking device. The roll sensor and locking device is illustrated in solid lines in its locked position, while the phantom lines illustrate the unlocked position.

Each actuator (44) is specifically shaped for the dispensing location or station (31) to provide positive spindling location while allowing a maximum of lifting power exerted at the hollow core ends of the rolled product, FIG. 3. The actuators (45) are specifically shaped for insertion beneath and engaging and supporting a roll (a) at the primary reserve roll position or station (32). The actuators (50), at the secondary reserve roll location or station (33), function in a manner similar to the dispensing actuators (44). The actuators (45) are joined together by connecting arms (47); by means of pivot pins (58), rivets, or the like, while the actuators (45 and 50) are pivotally connected together by corresponding connecting arms (48) and pivot pins (58).

The cooperative and synchronized movement of the actuator assemblies in both compartments (13 and 14) is accomplished by the operator or changing mechanism (25). The operator or changing mechanism (25) preferably includes an elongated transverse handle member or handle bar (60) located in front of the lower portion of the dispenser (10). Projecting rearward from opposite end portions of the handle bar (60) are a pair of handle arms (61) which extend through corresponding slots (49) in the lower end portions of link arms (46) depending from and pivotally supported by pivot pins (59) from the dispensing actuators (44). The handle arms continue rearward through slots (62) in the mounting plates (40) and terminate in their pivotal connection upon the pivot shaft or axle (26). The positive return of the changing mechanism (25) to its upper operational position, as shown in solid lines in FIG. 4, is assured by a spring (38) which joins the changing mechanism (25) through a hole provided therein, and attaches to a spring retainer (39) mounted on the interior shaft wall (30) FIG. 4.

The pivotally mounted paper sensor or sensor finger (36) is kept in an upright position by the sheet material present on the dispensing roll (a), and in conjunction and cooperation with the lower locking device (34) retains the locking device (34) in a locked position; preventing operation of the changing mechanism (25). However, when virtually all of the sheet material has been consumed, the counterweighted sensor tip (37) is biased to fall or protrude into the roll chamber (12) to unlatch and move the locking device (34) away from its latched position in solid lines, to its phantom unlatched position in FIG. 5, to permit the changing mechanism (25) freedom to operate. The sensor finger (36) and the locking device (34) are pivotally mounted by pins (64 and 65), respectively, to a mounting bracket (35), which is attached to the internal shaft wall (30), and allows simultaneous pivotal movement of the sensor (36) and the locking device (34). The sensor finger (36) and the locking device or block (34) are cooperatively interconnected by means, not shown. It will be noted in FIG. 5 that the locking device or block (34) is shown in its solid-line locked position immediately below the handle arm (61) to prevent the handle arm (61) from moving downward.

Actuation and Transfer Method

After the dispenser (10) in its operational position in FIG. 1, has been exhausted of paper at the dispensing station (31); the paper sensor tip (37) protrudes into the roll chamber (12), (a movement urged and caused by gravity [toggle]) as there is no sheet material to restrict the intrusion. The paper sensor (36) shifts to its phantom position in FIG. 5, and moves the locking device (34) to its unlatched position, allowing the changing mechanism (25) operational movement FIG. 5.

The dispenser (10) is activated by the downward movement of the changing mechanism (25) to its phantom position in FIG. 4, which causes the withdrawal of actuators (44) at the dispensing station (31) and actuators (45) at the primary reserve station (32) while causing the intrusion of actuators (50) at the secondary reserve station (33), FIG. 2. As this transference occurs: (1) the exhausted roll (core [c]) is released from actuators (44), and falls to the partial bottom wall (24) of the cabinet, causing automatic ejection of said core (c) through the transverse bottom opening (70), in front of the foreshortened bottom wall (24) FIG. 8; (2) the actuators (50) at the secondary reserve station (33) intrude and engage the secondary reserve roll at the hollow core ends, retaining the secondary reserve roll and all rolls stationed above that position; (3) the actuators (45) at the primary reserve station (32) withdraw allowing the primary reserve roll to drop to the bottom wall (24) in the dispensing station (31). As the primary reserve roll drops to the dispensing station (31), it contacts the paper sensor tip (37), urging the paper sensor (36) to retract into the side compartment (13 and 14); thereby forcing the locking device (34) into its latched position to prevent the operation of the handle arms (61) and the changing mechanism (25).

It will be noted in FIG. 8, that the lower edge (73) of the front shield (20) terminates substantially above the bottom wall (24) to form a transverse front opening (71) in the dispenser (10). The front opening (71) merges with the bottom opening (70) to form a continuous opening between the bottom edge (72) of the lower shield (20) and the front edge (74) of the bottom wall (24). The span or distance between the edges (73 and 74) is less than the diameter of a full roll (a) of sheet material, but is of greater dimension than the diameter of the empty core (c).

It will also be noted in FIG. 8 that the handle bar (60) of the changing mechanism (25) operates vertically across the lower front opening (71) to prevent the removal of a full roll, or even a partially full roll, from the lower portion of the dispenser (10).

Each of the actuators (44, 45, and 50) is preferably cam-shaped or eccentric-shaped relative to its corresponding rotary axis, which is coaxial with its pivot pin (41). Furthermore, each of the actuators (44, 45, and 50) is provided with a radial projection for intrusion into the roll chamber (12) or withdrawal therefrom. The radial projections of the dispensing actuators (44) may take the form of a radial ledge portion (75), so shaped and located that when the actuator (44 or 50) is in its operative position for insertion into and engaging the upper surface of the inner core (c), that the roll on that core is fully supported within the roll chamber and prevented from moving downward in the roll chamber (12).

The radial projections of the actuators (45) in the primary reserve station (32) are so shaped that when they protrude into the roll chamber (12), they will engage the opposite bottom surfaces of the end portions of the corresponding roll in the primary reserve station (32) to prevent the primary reserve roll from further descent and also to space it above the lower roll in the dispensing station (31). As disclosed in the drawings, and particularly FIGS. 1, 2, and 5, the radial projections of the actuators (45) have a circumferential arcuate roll engaging surface (76).

It will be observed in the drawings, that all of the actuators (44, 45, and 50) are uniform in construction, primarily for purposes of economy and to facilitate mass production. However, it is not necessary that these actuator (44, 45, and 50) be identical in shape and construction, so long as they are eccentrically shaped and provided with their corresponding radial projections for rotary movement about their respective pivot pins (41).

What is claimed is:

1. An apparatus for holding and dispensing rolls of sheet material having axial cores comprising:

(a) an upright roll chamber having front and rear portions and a pair of opposed, transversely spaced upright side walls, said roll chamber being adapted to receive a plurality of vertically stacked, transversely extending rolls of sheet material having axial cores and opposite end portions, (b) said roll chamber comprising a lower dispensing station, a primary reserve station above said dispensing station, and a secondary reserve station above said primary reserve station, (c) a pair of first rotary actuators, (d) first mounting means supporting each of said first rotary actuators on the opposite sides of said corresponding side walls from said roll chamber for reciprocable rotary motion about a first horizontal front-to-rear rotary axis, (e) each of said first rotary actuators comprising a first ledge portion projecting radially from said first rotary axis and adapted to swing between a lower position below said first rotary axis disengaging a roll of sheet material, and an upper position within said roll chamber engaging a roll of sheet material in said dispensing station, (f) a pair of second rotary actuators having corresponding second radial roll-engaging projections, (g) second mounting means supporting each of said second rotary actuators on the opposite sides of said corresponding side walls from said roll chamber for reciprocal rotary motion about a second horizontal front-to-rear rotary axis to cause said second radial projections to move into and out of engagement with the opposite end portions of a roll of sheet material in said primary reserve station, (h) a pair of third rotary actuators, (i) third mounting means supporting each of said third rotary actuators on the opposite sides of said corresponding side walls from said roll chamber for reciprocable rotary motion about a third horizontal front-to-rear rotary axis, (j) each of said third rotary actuators comprising a third ledge portion projecting radially from said third rotary axis and adapted to swing between a lower position below said third rotary axis disengaging a roll of sheet material and an upper position within said roll chamber engaging a roll of sheet material in said secondary reserve station, (k) link means connecting said pairs of first, second and third rotary actuators whereby said actuators rotate about said corresponding rotary axes between a first dispensing position in which said first ledge portions are in said upper positions, said second radial projections engage the opposite end portions of a roll in said primary reserve station, and said third ledge portions are in said lower positions, and a second transfer position in which said first ledge portions are in said lower positions, said second radial projections disengage any rolls in said primary reserve station, and said third ledge portions are in said upper positions, and (l) operator means operatively connected to said link means for shifting said rotary actuators between said first dispensing position and said second transfer position.

2. The invention according to claim 1, in which said first ledge portions are adapted to be inserted into the opposite end portions of a hollow core of a roll supported in said dispensing station, and to lift and support said corresponding hollow core when said first ledge portions are rotated from their lower positions to their upper positions.

3. The invention according to claim 1, in which each of said second radial projections terminates in an arcuate roll-engaging portion for engaging the lower surface of a roll in said primary reserve station.

4. The invention according to claim 3, in which each of said arcuate roll-engaging portions continually engages said corresponding lower surfaces of said roll to maintain said roll in said primary reserve station as said second rotary actuators rotate upward, while said first rotary actuators rotate downward from said upper positions toward said lower positions, and until said arcuate portions disengage said roll.

5. The invention according to claim 1, in which said link means comprises an operator link arm pivotally connecting each of said first rotary actuators to said operator means, a first connecting arm pivotally connecting each of said corresponding first and second rotary actuators, and a second connecting arm pivotally connecting each of said corresponding second and third rotary actuators, whereby vertical movement of said operator link arms causes said second and third rotary actuators to rotate in the same direction and said first rotary actuators to rotate in the opposite direction from said second and third rotary actuators.

6. The invention according to claim 5, further comprising pivotal connections between said link arms and said rotary actuators which are eccentric to said corresponding rotary axes of said actuators.

7. The invention according to claim 1, in which said roll chamber further comprises a front wall and a lower transverse dispensing opening through the bottom portion of said front wall to permit passage of sheet material from a roll supported in said dispensing station, said operator means comprising a handle member exteriorly of said roll chamber, a handle arm member projecting from said handle member and terminating in a rear end portion, and hinge means pivotally securing said rear end portion to said roll chamber, said link means comprising a depending link arm pivotally connected to a corresponding first rotary actuator, and means operatively connecting said depending link arm to said handle arm member, whereby said rotary actuators are in said first dispensing position when said handle member is in a first operative position and said rotary actuators are in said second transfer position when said handle member is in a second operative position, said handle member being adapted to move vertically and reciprocably only over said front dispensing opening.

8. The invention according to claim 7, further comprising a latch member pivotally mounted below said handle arm member and adapted to pivotally move between a latch position beneath said handle arm member and an unlatched position to permit free vertical movement of said handle arm member, sensor means operatively connected to said latch member and adapted to sense the presence of a roll of sheet material in said dispensing station, said sensor means actuating said latch member into said latch position when said sensor means senses said roll in said dispensing station, and said latch member being adapted to move to an unlatching position when said sensor means no roll in said dispensing station.

9. The invention according to claim 8, in which said sensor means comprises a sensor finger and means pivotally mounting said sensor finger adjacent said roll chamber, said sensor finger being biased toward entry of said sensor finger into said roll chamber in the absence of a roll in said dispensing station, said sensor finger being forced to swing away from said roll chamber when a roll is in said dispensing station causing said latch member to move to said latch position.

10. The invention according to claim 9, in which said sensor finger has a sensor tip portion normally biased into said roll chamber and a lower end portion beneath said pivotal axis cooperating with said pivotal latch member.

* * * * *